US011131103B2

(12) United States Patent
Woodward et al.

(10) Patent No.: US 11,131,103 B2
(45) Date of Patent: Sep. 28, 2021

(54) ASSEMBLY, PLANK ADAPTER FOR A WORK STAND AND METHOD

(71) Applicants: Steve Woodward, Meadville, PA (US); Shannon Lessner, Madison, WI (US); Thomas Parker, Jamestown, PA (US)

(72) Inventors: Steve Woodward, Meadville, PA (US); Shannon Lessner, Madison, WI (US); Thomas Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 15/077,528

(22) Filed: Mar. 22, 2016

(65) Prior Publication Data

US 2017/0275898 A1 Sep. 28, 2017

(51) Int. Cl.

| | |
|---|---|
| ***E04G 1/28*** | (2006.01) |
| ***E04G 1/30*** | (2006.01) |
| ***E06C 7/16*** | (2006.01) |
| ***E06C 1/39*** | (2006.01) |
| ***E04G 5/02*** | (2006.01) |

(52) U.S. Cl.

CPC ..... *E04G 1/28* (2013.01); *E04G 1/30* (2013.01); *E04G 5/02* (2013.01); *E06C 1/39* (2013.01); *E06C 7/16* (2013.01); *E04G 2001/307* (2013.01)

(58) Field of Classification Search

CPC .. E04G 1/28; E04G 1/32; E04G 1/152; E04G 5/02; B25H 1/06

See application file for complete search history.

(56) References Cited

U.S. PATENT DOCUMENTS

| | | | | | |
|---|---|---|---|---|---|
| 711,384 | A * | 10/1902 | Carman | E04G 1/152 | 182/119 |
| 967,898 | A * | 8/1910 | Gilmore | E04G 1/152 | 182/119 |
| 982,083 | A * | 1/1911 | McGhan | E04G 1/30 | 182/118 |
| 2,335,046 | A * | 11/1943 | Droeger | E04G 1/152 | 182/119 |
| 2,739,847 | A * | 3/1956 | Webb | E04G 1/28 | 182/186.6 |

(Continued)

FOREIGN PATENT DOCUMENTS

| | | | | |
|---|---|---|---|---|
| DE | 3822289 A1 * | 1/1990 | ..... | E04G 1/32 |
| DE | 3822289 A1 * | 1/1990 | ..... | E04G 1/32 |

(Continued)

*Primary Examiner* — Alvin C Chin-Shue
*Assistant Examiner* — Candace L Bradford
(74) *Attorney, Agent, or Firm* — Ansel M. Schwartz

(57) ABSTRACT

An assembly upon which a user stands includes a platform. The assembly includes a first work stand and a second work stand. Each work stand has a front frame and a rear frame. The assembly includes a first plank adapter engaged with the first work stand. The first plank adapter has an attachment portion and a bar. The assembly includes a second plank adapter engaged with the second work stand. The platform rests on is supported by the first and second plank adapters. The present invention pertains to a work stand for holding a platform upon which a user stands. A plank adapter that is engaged with a front frame of a work stand to hold a platform. A method for a user to stand above ground. A method for forming a work stand.

7 Claims, 14 Drawing Sheets

(56) References Cited

U.S. PATENT DOCUMENTS 2,808,296 A * 10/1957 Stinson ..... E04G 1/151 182/222
2,854,290 A * 9/1958 Steen ..... E04G 1/32 182/178.1
2,966,957 A * 1/1961 Ireland ..... E04G 1/28 182/224
3,388,771 A * 6/1968 Corneliusen ..... E04G 1/34 182/153
3,690,407 A * 9/1972 Cullison ..... E04G 1/22 182/119
4,132,397 A * 1/1979 Ward ..... B25B 1/2484 248/201
4,241,808 A * 12/1980 Middleton ..... B25H 1/06 182/155
4,537,282 A * 8/1985 Lobdell ..... E04G 5/00 182/117
4,570,915 A * 2/1986 O'Hern ..... B23D 57/0092 182/151
4,586,586 A * 5/1986 Canals ..... E06C 1/12 182/118
5,141,078 A * 8/1992 Wood ..... E04G 1/152 182/119
5,144,994 A * 9/1992 Stecker, Sr. ..... B23D 47/025 144/286.1
5,289,897 A * 3/1994 Wiehe, Jr. ..... B25H 1/06 182/154
5,678,653 A * 10/1997 Clinch ..... E04G 1/14 182/118
6,003,823 A * 12/1999 Hoffman ..... B63C 5/02 248/163.2
8,844,677 B1 * 9/2014 Young, II ..... E04G 1/38 182/224
8,888,084 B1 * 11/2014 Aldredge ..... B25B 1/22 269/95
2003/0159885 A1 * 8/2003 Sullivan, Jr. ..... E06C 1/39 182/151
2004/0003966 A1 * 1/2004 Yeoman ..... E04G 1/32 182/118
2005/0115767 A1 * 6/2005 Moss ..... E06C 7/16 182/119
2009/0020364 A1 * 1/2009 Wolfe, III ..... E04G 1/152 182/222
2016/0346570 A1 * 12/2016 Anson ..... E04G 5/10

FOREIGN PATENT DOCUMENTS

DE 4205621 A1 * 10/1993 ..... E04G 1/32
DE 4205621 A1 * 10/1993 ..... E04G 1/32
GB 1526925 A * 10/1978 ..... E04G 1/32
GB 1526925 A * 10/1978 ..... E04G 1/32

* cited by examiner

ASSEMBLY, PLANK ADAPTER FOR A WORK STAND AND METHOD

FIELD OF THE INVENTION

The present invention is related to work platforms having a plank adapter upon which hooks of a platform rest to form a scaffold on which a user stands. (As used herein, references to the "present invention" or "invention" relate to exemplary embodiments and not necessarily to every embodiment encompassed by the appended claims.) More specifically, the present invention is related to work platforms having a plank adapter upon which hooks of a platform rest to form a scaffold on which a user stands where the plank adapter has a bar in spaced relationship with the work stand upon which the hooks of the platform rest.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Scaffolds are commonly used to provide a support structure for a user to stand upon and an elevated height. A typical scaffold requires specifically dedicated components which serve to form of the scaffold. However, there are times when it would be advantageous to take components that have other applications then specifically dedicated to form the scaffold, to also be used to form the scaffold. For instance, work stands, by themselves, can be used as a simple and short stepladder. It would be advantageous for work stands to also serve as supports for a platform to create a scaffold.

BRIEF SUMMARY OF THE INVENTION

The present invention pertains to and assembly upon which a user stands. The assembly comprises a platform having a first hook and a second hook extending from a first end of the platform, and a third hook and a fourth hook extending from a second end of the platform. The second end of the platform in opposition with and spaced relation with the first end of the platform. The platform defining a plane on which the user stands. The assembly comprises a first work stand. The assembly comprises a second work stand. Each work stand has a front frame and a rear frame. Each frame has a first rail and a second rail in parallel and spaced relationship with the first rail, a front cross bar engaged with the first and second rails of the front frame, a rear cross bar engaged with the first and second rails of the rear frame, a first spreader engaged with the first rail of the front frame and the first rail of the rear frame, a second spreader engaged with the second rail of the front frame and the second rail of the rear frame. The front frame and the rear frame of each work stand forms an upside down V. The front frame's top engaged with the rear frame's top. The assembly comprises a first plank adapter engaged with the first work stand. The first plank adapter has an attachment portion and a bar. The attachment portion is engaged with the bar and the first work stand to hold the bar in spaced relationship with the first work stand. The first and second hooks on the first end of the platform engage with and rest on the bar to hold the platform in place on the bar. The assembly comprises a second plank adapter engaged with the second work stand.

The second plank adapter has a bar on which the third and fourth hooks on the second side of the platform engage with and rest to hold the platform in place on the bar of the second work stand.

The present invention pertains to a work stand for holding a platform upon which a user stands. The platform has a first hook and a second hook extending from a first end of the platform, and a third hook and a fourth hook extending from a second end of the platform which are supported by a second work stand. The second end of the platform in opposition with and spaced relation with the first end of the platform. The platform defines a plane on which the user stands. The first work stand comprises a front frame and a rear frame. Each frame has a first rail and a second rail in parallel and spaced relationship with the first rail, a front cross bar engaged with the first and second rails of the front frame, a rear cross bar engaged with the first and second rails of the rear frame, a first spreader engaged with the first rail of the front frame and the first rail of the rear frame, a second spreader engaged with the second rail of the front frame and the second rail of the rear frame. The front frame and the rear frame form an upside down V. The front frame's top engaged with the rear frame's top. The workstation comprises a first plank adapter engaged with the front frame. The first plank adapter has an attachment portion and a bar. The attachment portion is engaged with the bar and the front frame to hold the bar in spaced relationship with the first work stand. The first and second hooks on the first end of the platform engage with and rest on the bar to hold the platform in place on the bar.

The present invention pertains to a plank adapter that is engaged with a front frame of a work stand to hold a platform. The platform has a first hook and a second hook. The adapter comprises an attachment portion; and a bar. The attachment portion is engaged with the bar and the front frame to hold the bar in spaced relationship with the first work stand. The first and second hooks on the platform engage with and rest on the bar to hold the platform in place on the bar.

The present invention pertains to a method for a user to stand above ground. The method comprises the steps of unfolding a first work stand having a first plank adaptor and placing the first work stand at a desired first location. There is the step of unfolding a second work stand having a second plank adaptor and placing the second work stand at a desired second location. There is the step of placing a first hook and a second hook of a platform on the plank adaptor of the first work stand. There is the step of placing a third hook and a fourth hook of the platform on the plank adaptor of the work stand so the platform is supported by the first and second work stands above ground. The first plank adapter is engaged with a front frame of the first work stand. The first plank adapter has an attachment portion and a bar. The attachment portion is engaged with the bar and the front frame to hold the bar in spaced relationship with the first work stand. The second plank adapter is engaged with a front frame of the second work stand. The second plank adapter has an attachment portion and a bar. The attachment portion is engaged with the bar of the second work stand and the front frame of the second work stand to hold the bar of the second work stand in spaced relationship with the second work stand.

The present invention pertains to a method for forming a work stand. The method comprises the steps of attaching a first flange of a plank adapter to the outside of a first rail of a front frame. The front frame is engaged with a rear frame. The front and rear frames form an upside down V when in use. There is the step of attaching a second flange of the plank adapter to the outside of a second rail of the front frame. The second rail in parallel and spaced relationship with the first rail. There is a bar engaged with and extending between the first flange and the second flange. The first and second flanges holding the bar in spaced relationship with the front frame.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
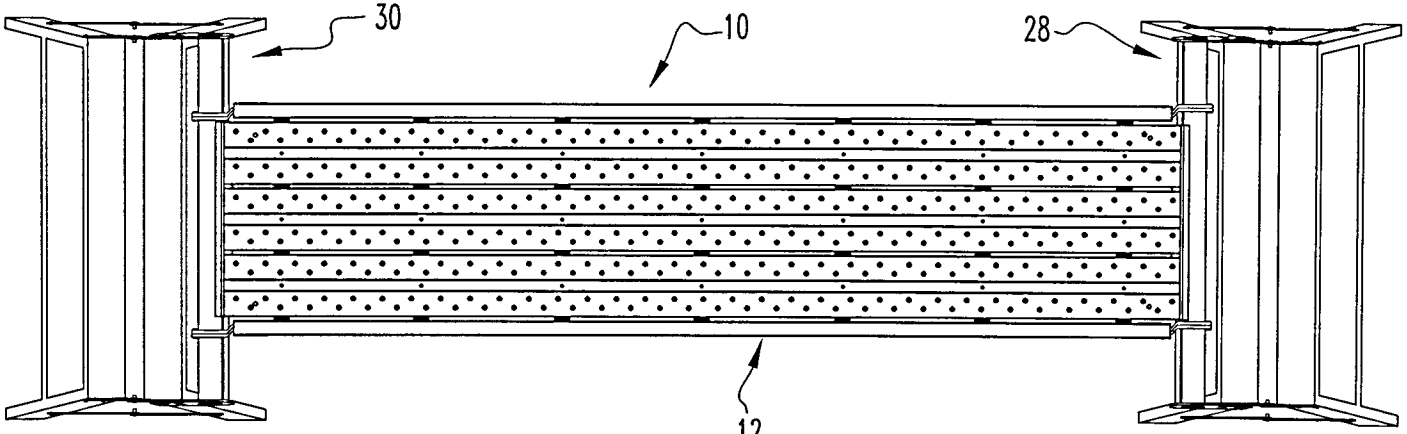
FIG. 1 is an overhead view of the assembly of the present invention.
Figure 2:
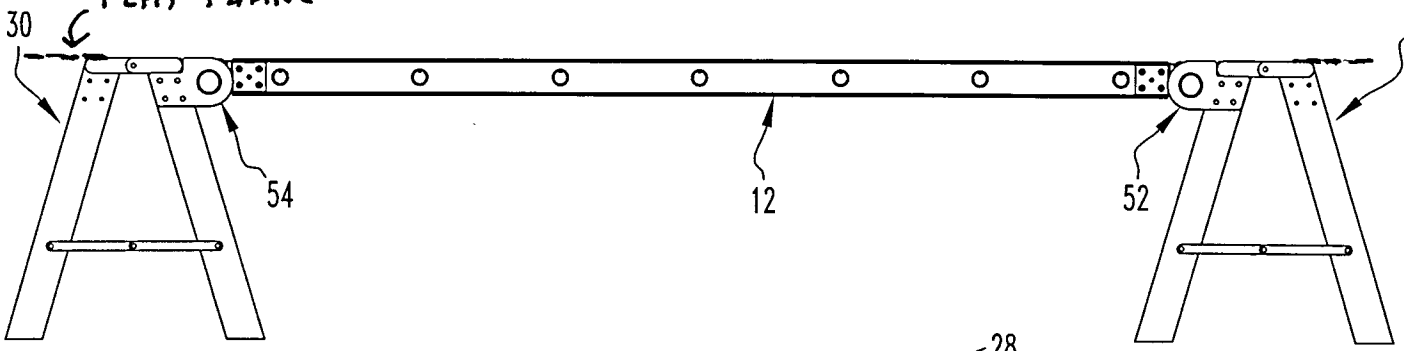
FIG. 2 is a side view of the assembly.
Figure 3:
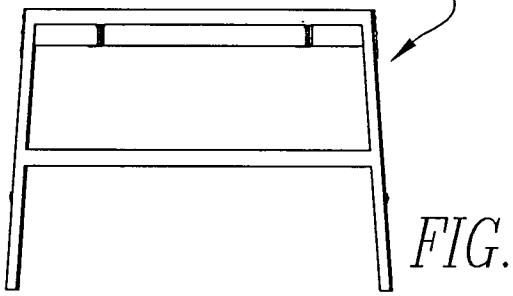
FIG. 3 is a front view of the assembly.

Referring now to the drawings wherein like reference numerals refer to similar or identical parts throughout the several views, and more specifically to FIGS. 1-13 thereof, there is shown an assembly 10 upon which a user stands. The assembly 10 comprises a platform 12 having a first hook 14 and a second hook 16 extending from a first end 22 of the platform 12, and a third hook 18 and a fourth hook 20 extending from a second end 24 of the platform 12. The second end 24 of the platform 12 in opposition with and spaced relation with the first end 22 of the platform 12. The platform 12 defining a plane 26 on which the user stands. The assembly 10 comprises a first work stand 28. The assembly 10 comprises a second work stand 30. Each work stand has a front frame 32 and a rear frame 34. Each frame has a first rail 40 and a second rail 42 in parallel and spaced relationship with the first rail 40, a front cross bar 36 engaged with the first and second rails 40, 42 of the front frame 32, a rear cross bar 38 engaged with the first and second rails 40, 42 of the rear frame 34, a first spreader 44 engaged with the first rail 40 of the front frame 32 and the first rail 40 of the rear frame 34, a second spreader 46 engaged with the second rail 42 of the front frame 32 and the second rail 42 of the rear frame 34. The front frame 32 and the rear frame 34 of each work stand forms an upside down V. The front frame's top 48 engaged with the rear frame's top 50. The assembly 10 comprises a first plank adapter 52 engaged with the first work stand 28. The first plank adapter 52 has an attachment portion 56 and a bar 58. The attachment portion 56 is engaged with the bar 58 and the first work stand 28 to hold the bar 58 in spaced relationship with the first work stand 28. The first and second hooks 14, 16 on the first end 22 of the platform 12 engage with and rest on the bar 58 to hold the platform 12 in place on the bar 58. The assembly 10 comprises a second plank adapter 54 engaged with the second work stand 30. The second plank adapter 54 has a bar 58 on which the third and fourth hooks 18, 20 on the second side of the platform 12 engage with and rest to hold the platform 12 in place on the bar 58 of the second work stand 30.

The bar 58 may have a first end 60 and a second end 62, the attachment portion 56 may have a first flange 64 engaged with the bar 58 in proximity to the first end 60 of the bar 58 and to the first rail 40 of the front frame 32 of the first work stand 28, and the attachment portion 56 may have a second flange 66 engaged with the bar 58 in proximity to the second end 62 of the bar 58 and to the second rail 42 of the front frame 32 of the first workstation. The first flange 64 may be engaged with the outside of the first rail 40 of the front frame 32 of the first workstation, and the second flange 66 is engaged with the outside of the second rail 42 of the front frame 32 of the first workstation.

The assembly 10 may include fasteners 68 that attach each flange to each flange's corresponding rail. The first flange 64 may be attached with the fasteners 68 in proximity to the top 70 of the first rail 40 of the first work stand 28 and the second flange 66 may be attached with the fasteners 68 in proximity to the top 70 of the second rail 42 of the first work stand 28. The bar 58 may have at least a portion 72 of its outer perimeter being curved to conform to the first hook 14 and the second hook 16 of the platform 12 that rests upon the bar 58.

The first flange 64 and the second flange 66 each may have an opening 74 in which the bar 58 of the first plank adapter 52 is fixed. The first flange 64 and the second flange 66 each may have a cut out 76 in which the top 70 of the first frame of the first work stand 28 fits. The first flange 64 and the second flange 66 each may have a first section 78 through which the fasteners 68 extend into the first rail 40 and the second rail 42, respective, and a second section 80 that may have the opening 74 in which the bar 58 of the first plank adapter 52 is fixed. The first section 78 may have three sides. The second section 80 may have essentially a half oval perimeter.

The present invention pertains to a work stand for holding a platform 12 upon which a user stands. The platform 12 has a first hook 14 and a second hook 16 extending from a first end 22 of the platform 12, and a third hook 18 and a fourth hook 20 extending from a second end 24 of the platform 12 which is supported by a second work stand 30. The second end 24 of the platform 12 in opposition with and spaced relation with the first end 22 of the platform 12. The platform 12 defines a plane 26 on which the user stands. The first work stand 28 comprises a front frame 32 and a rear frame 34. Each frame has a first rail 40 and a second rail 42 in parallel and spaced relationship with the first rail 40, a front cross bar 36 engaged with the first and second rails 40, 42 of the front frame 32, a rear cross bar 38 engaged with the first and second rails 40, 42 of the rear frame 34, a first spreader 44 engaged with the first rail 40 of the front frame 32 and the first rail 40 of the rear frame 34, a second spreader 46 engaged with the second rail 42 of the front frame 32 and the second rail 42 of the rear frame 34. The front frame 32 and the rear frame 34 form an upside down V. The front frame 32's top engaged with the rear frame's top 50. The workstation comprises a first plank adapter 52 engaged with the front frame 32. The first plank adapter 52 has an attachment portion 56 and a bar 58. The attachment portion 56 is engaged with the bar 58 and the front frame 32 to hold the bar 58 in spaced relationship with the first work stand 28. The first and second hooks 14, 16 on the first end 22 of the platform 12 engage with and rest on the bar 58 to hold the platform 12 in place on the bar 58.

The present invention pertains to a plank adapter that is engaged with a front frame 32 of a work stand to hold a platform 12. The platform 12 has a first hook 14 and a second hook 16. The adapter comprises an attachment portion 56; and a bar 58. The attachment portion 56 is engaged with the bar 58 and the front frame 32 to hold the bar 58 in spaced relationship with the first work stand 28. The first and second hooks 14, 16 on the platform 12 engage with and rest on the bar 58 to hold the platform 12 in place on the bar 58.

The present invention pertains to a method for a user to stand above ground. The method comprises the steps of unfolding a first work stand 28 having a first plank adaptor and placing the first work stand 28 at a desired first location. There is the step of unfolding a second work stand 30 having a second plank adaptor and placing the second work stand 30 at a desired second location. There is the step of placing a first hook 14 and a second hook 16 of a platform 12 on the plank adaptor of the first work stand 28. There is the step of placing a third hook 18 and a fourth hook 20 of the platform 12 on the plank adaptor of the work stand so the platform 12 is supported by the first and second work stands 28, 30 above ground. The first plank adapter 52 is engaged with a front frame 32 of the first work stand 28. The first plank adapter 52 has an attachment portion 56 and a bar 58. The attachment portion 56 is engaged with the bar 58 and the front frame 32 to hold the bar 58 in spaced relationship with the first work stand 28. The second plank adapter 54 is engaged with a front frame 32 of the second work stand 30. The second plank adapter 54 has an attachment portion 56 and a bar 58. The attachment portion 56 is engaged with the bar 58 of the second work stand 30 and the front frame 32 of the second work stand 30 to hold the bar 58 of the second work stand 30 in spaced relationship with the second work stand 30.

The present invention pertains to a method for forming a work stand. The method comprises the steps of attaching a first flange 64 of a plank adapter to the outside of a first rail 40 of a front frame 32. The front frame 32 is engaged with a rear frame 34. The front and rear frames 32, 34 form an upside down V when in use. There is the step of attaching a second flange 66 of the plank adapter to the outside of a second rail 42 of the front frame 32. The second rail 42 in parallel and spaced relationship with the first rail 40. There is a bar 58 engaged with and extending between the first flange 64 and the second flange 66. The first and second flanges 64, 66 holding the bar 58 in spaced relationship with the front frame 32.

Figure 4:
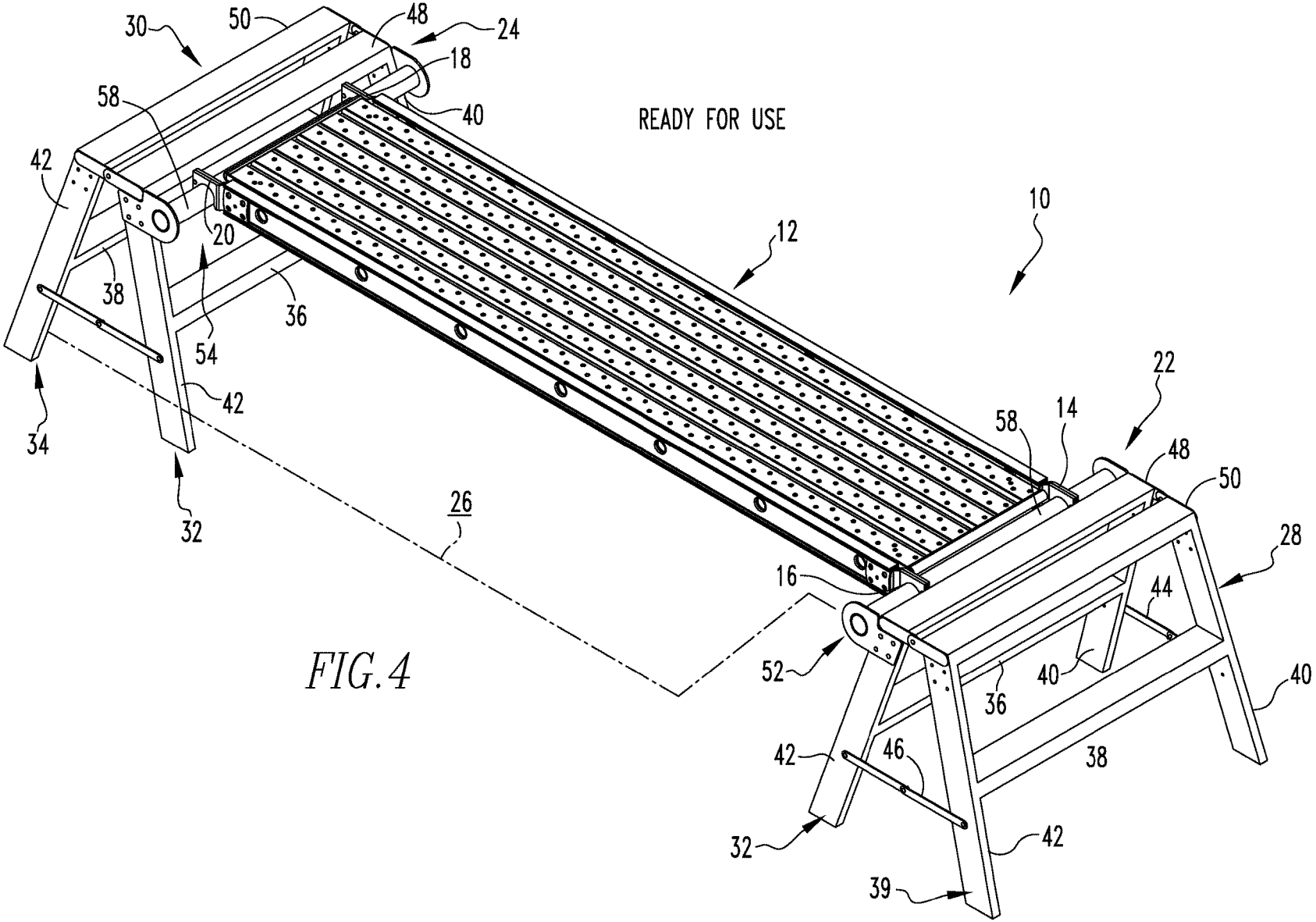
FIG. 4 is a perspective overhead view of the assembly.
Figure 5:
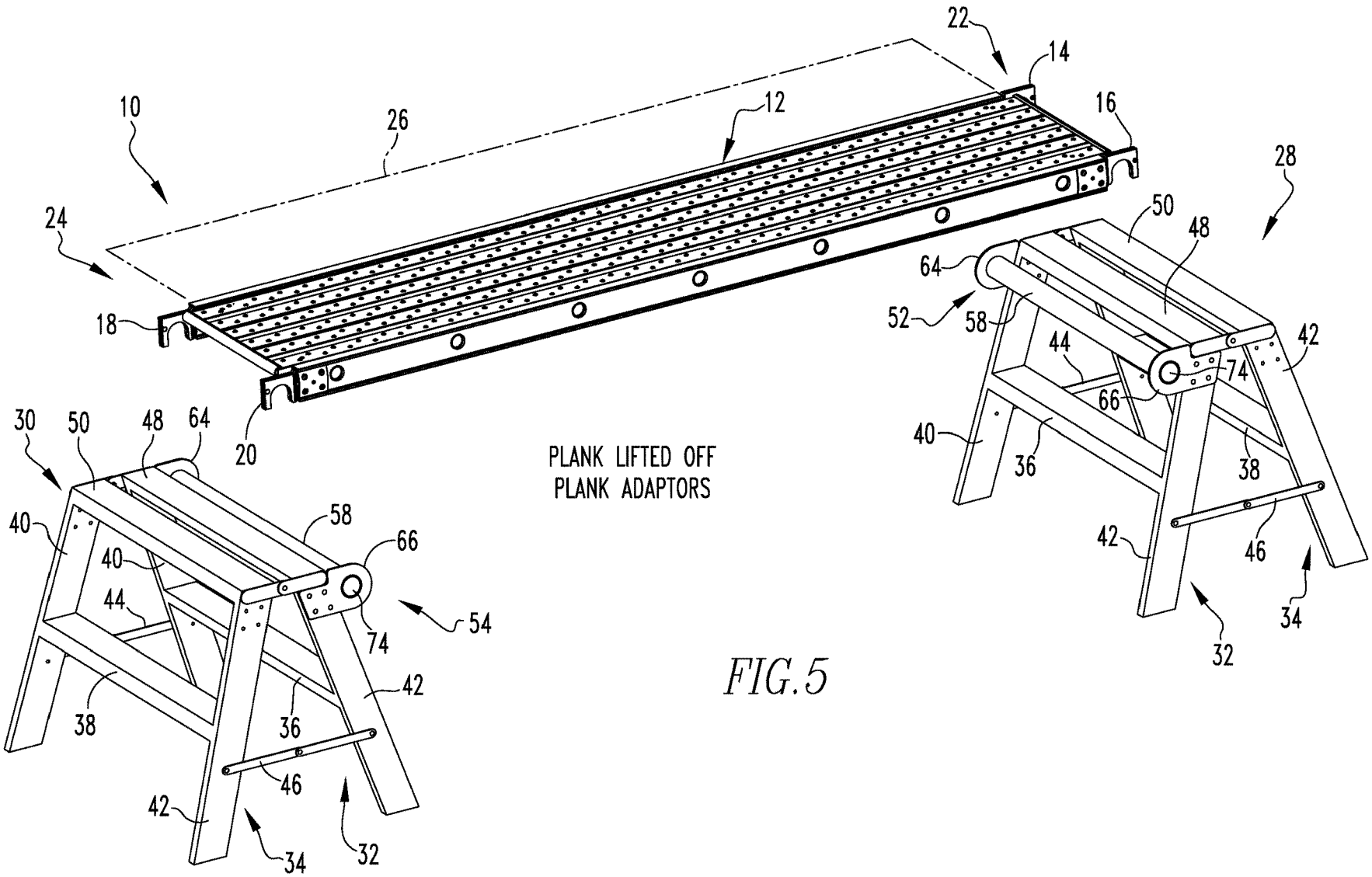
FIG. 5 is an overhead perspective exploded view of the assembly.
Figure 6:
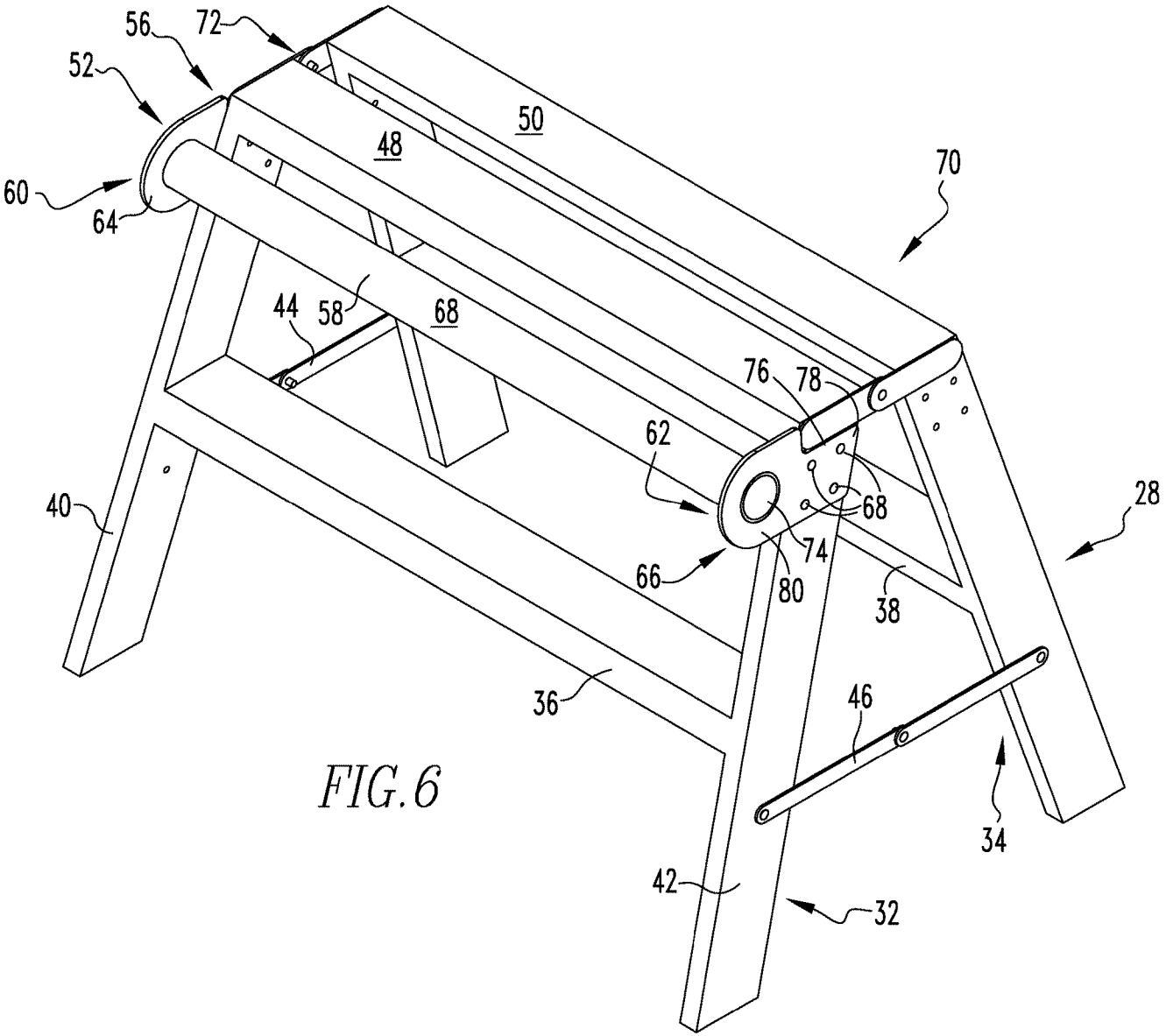
FIG. 6 is an overhead perspective view of a work stand of the present invention.
Figure 7:
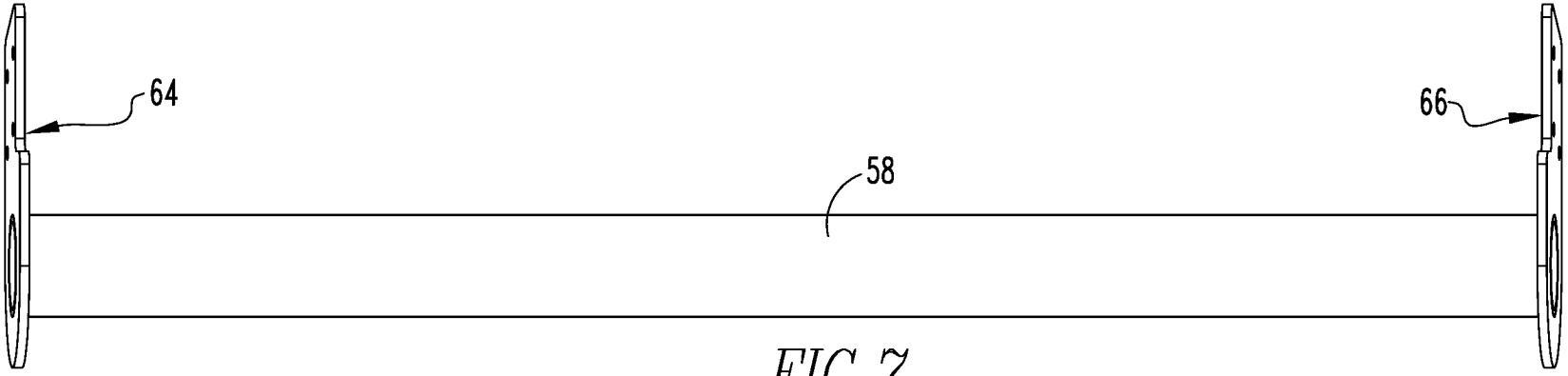
FIG. 7 is an overhead view of the plank adapter of the present invention.
Figure 8:
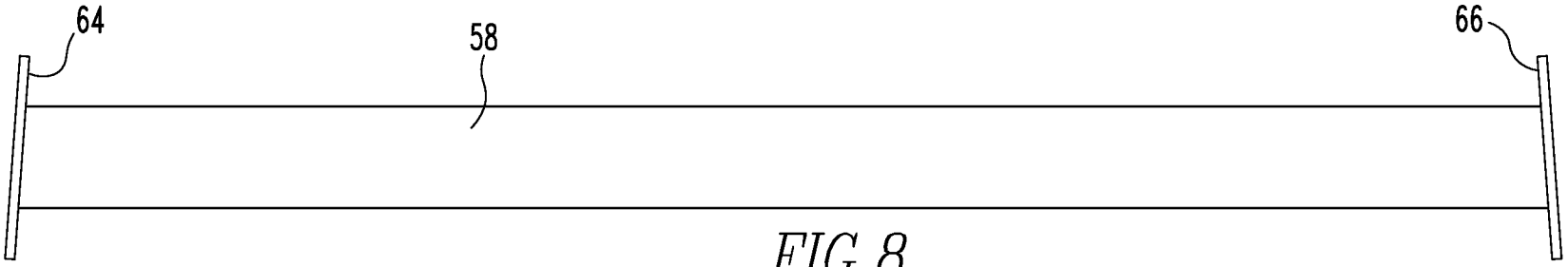
FIG. 8 is a front view of the plank adapter.
Figure 10:
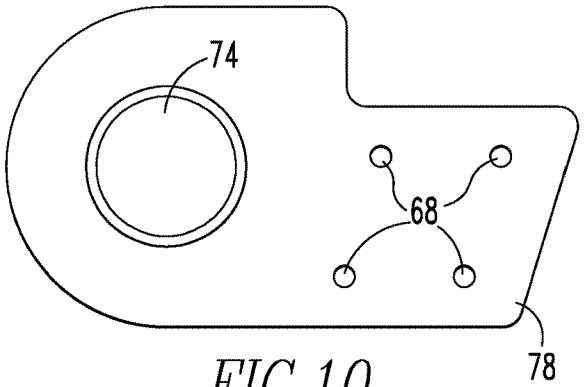
FIG. 10 is a side view of a first flange of the present invention.
Figure 9:
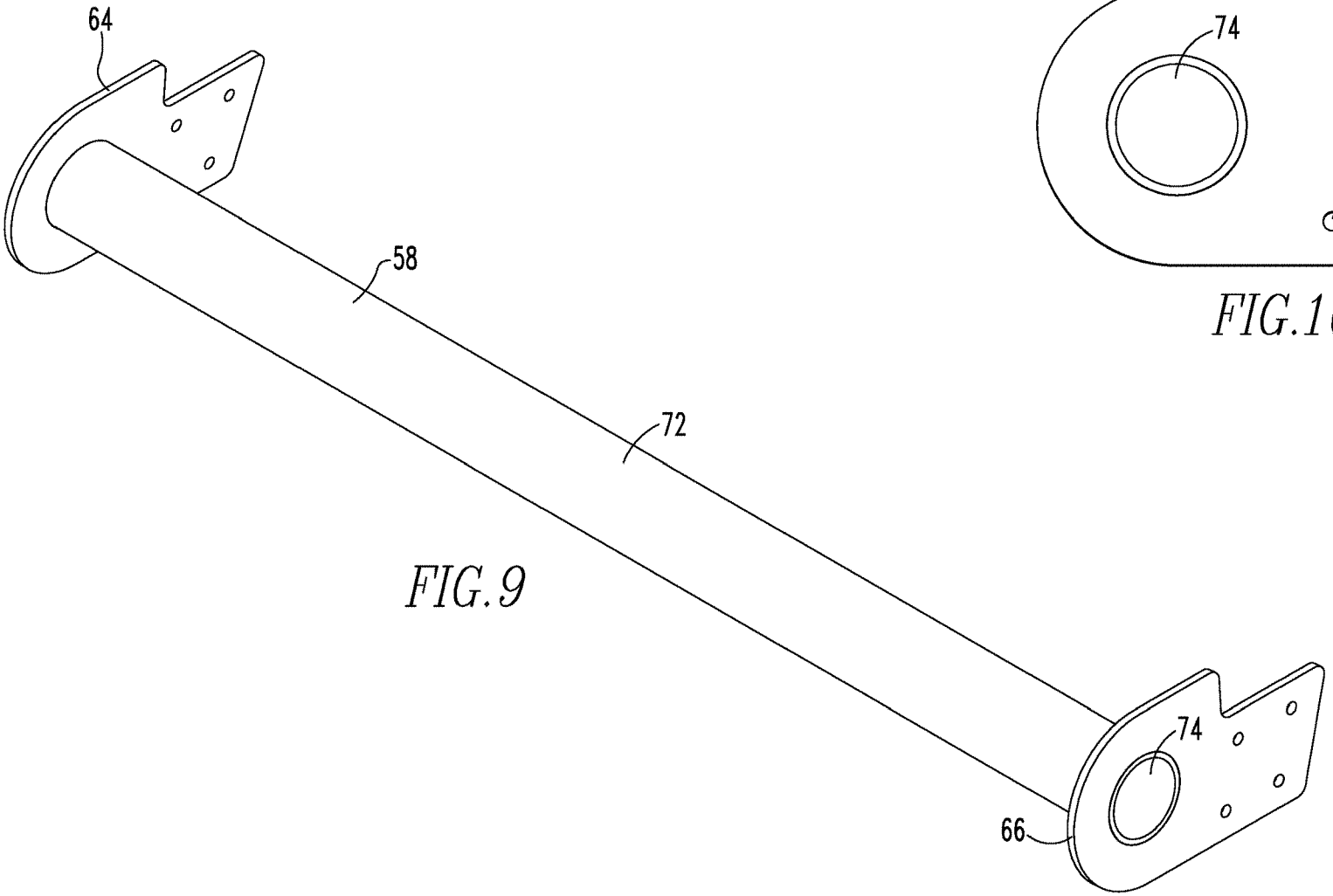
FIG. 9 is an overhead perspective view of the plank adapter.
Figure 11:
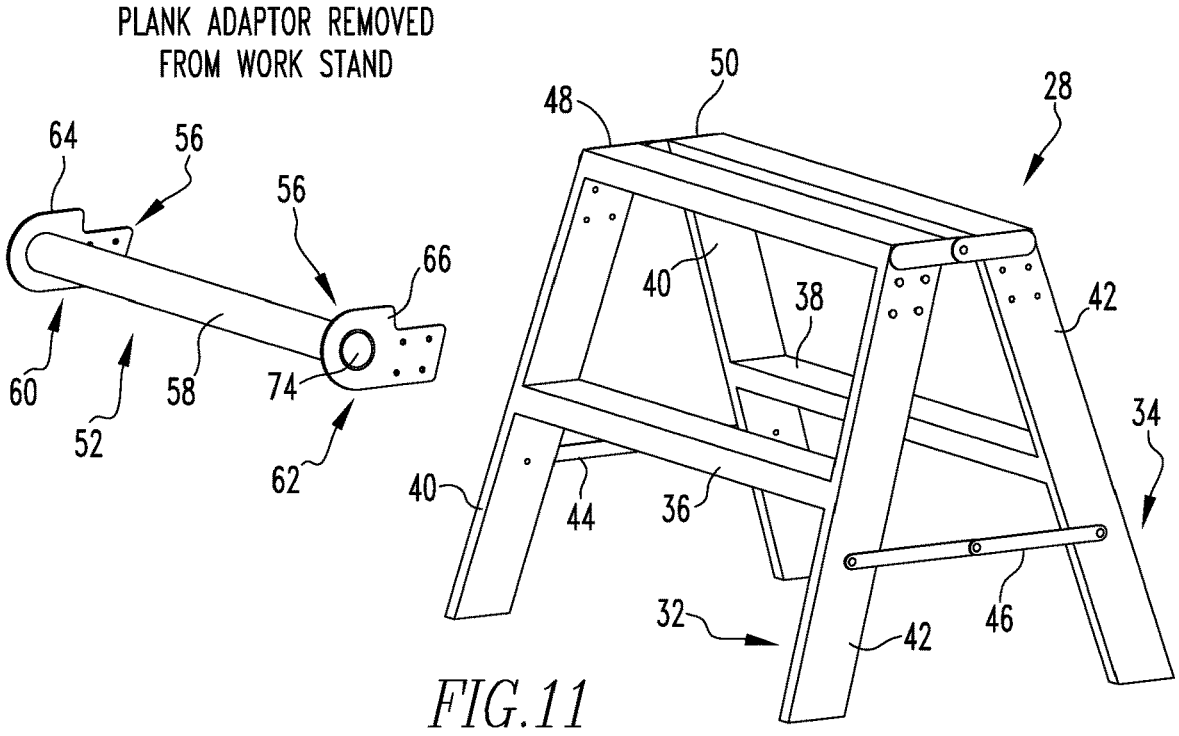
FIG. 11 is an overhead perspective exploded view of the first work stand in a use state.
Figure 12:
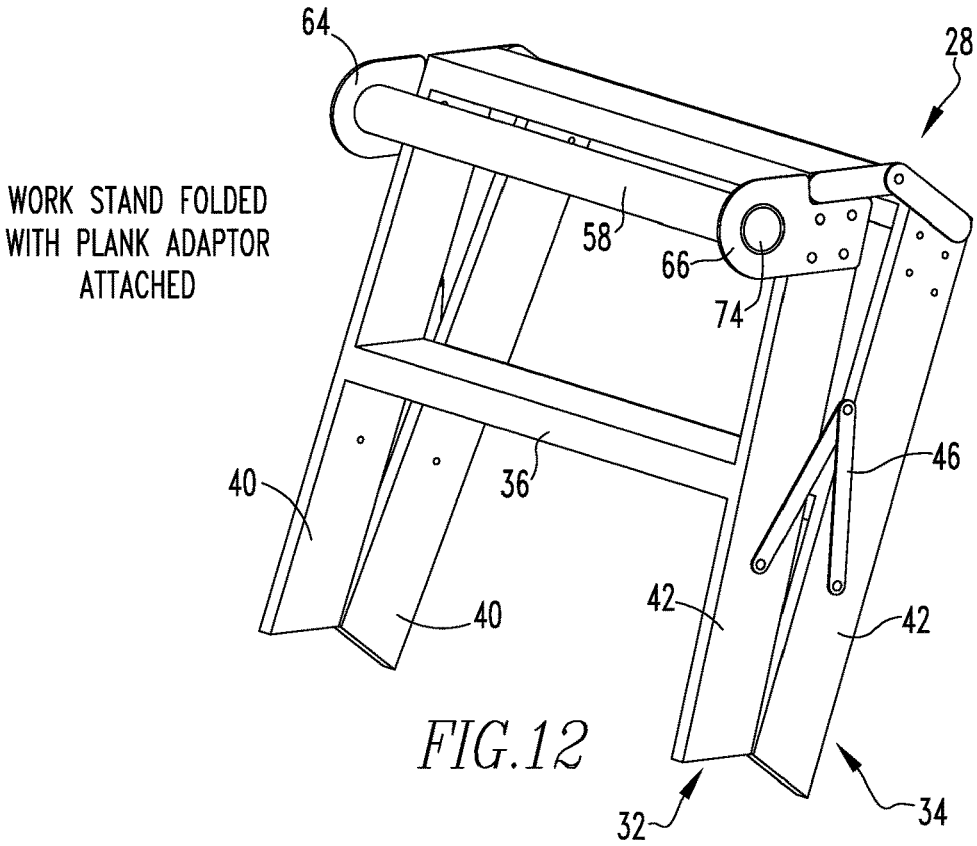
FIG. 12 is a perspective view of the work stand in a folded state.

In the operation of the invention, and with reference to FIGS. 4 and 5, the assembly 10 is formed by a user first rotating the first frame relative to the second frame of a first work stand 28 into a use state. The first frame and second frame are connected together at their top 70 and they rotate relative to each other about their top 70. The amount of rotation is limited by the spreaders that connect the first rails of the first and second frames and the second rails 42 of the first and second frames together. The user then positions a second work stand 30 with a plank adapter in the use position at a second desired location a distance apart equal to the distance between the first and second hooks 14, 16 of the platform 12 from the third and fourth hooks 18, 20 on the opposing side of the platform 12. The first and second hooks 14, 16 of the platform 12 are then rested on the bar 58 that is held in spaced relationship from the from the front frame 32 of the first work stand 28 by first and second flanges 64, 66 that are engaged with the top 70 of the first and second rails 42 of the front frame 32, respectively. The bar 58 is engaged with the first and second flanges 64, 66 through holes in the second sections 80 of each flange. The second section 80 of each flange is attached with fasteners 68 to the top 70 of its corresponding respective rail. With the platform 12 in place on the first and second work stands 28, 30, a scaffold is formed for the user to stand upon and work from to do whatever the user wishes.

Figure 13:
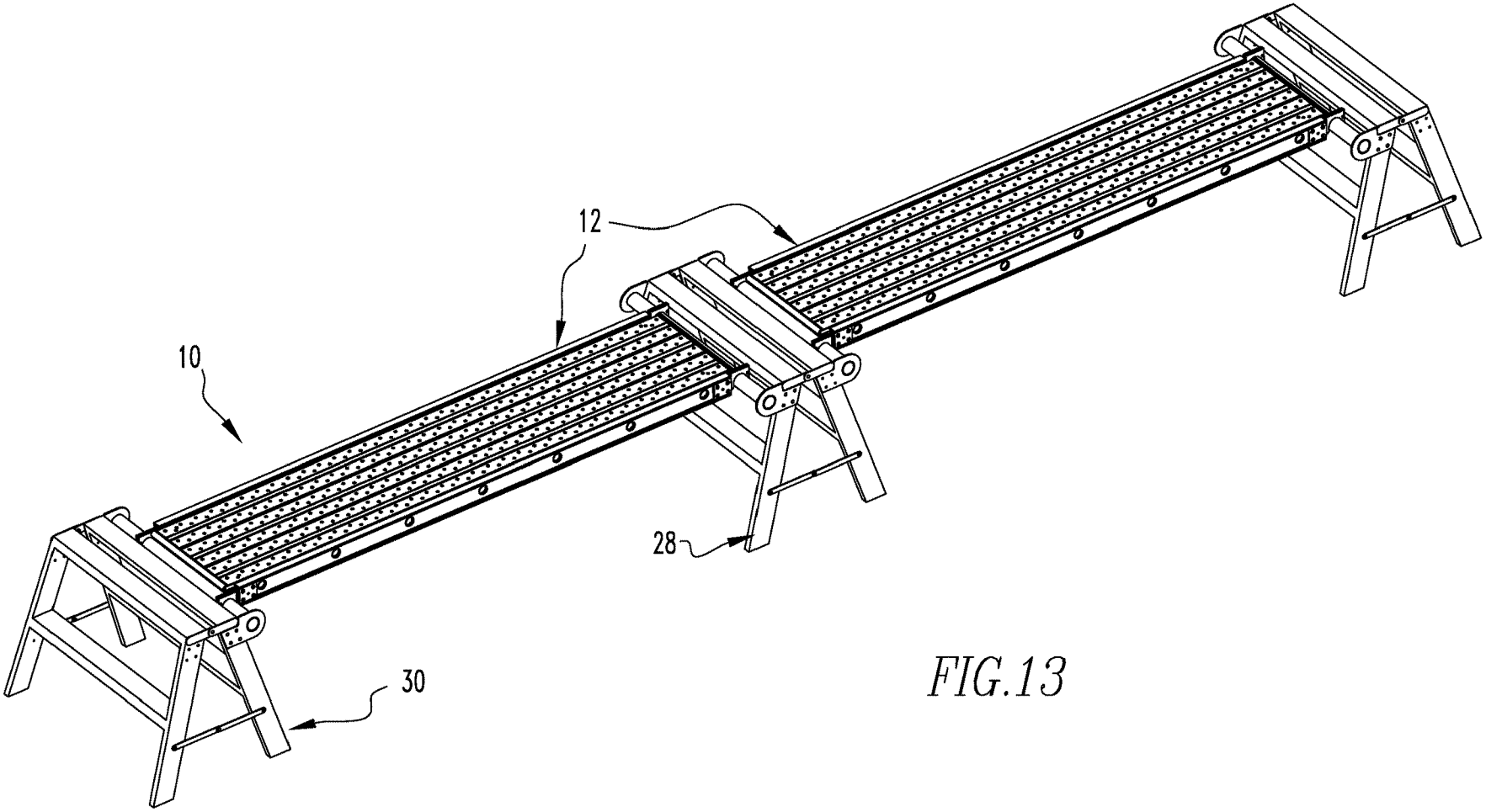
FIG. 13 is a perspective view of the assembly with two platforms and three work stands.

If desired, additional platforms 12 can be positioned in series, as shown in FIG. 13. In such an instance, each work stand that has a platform 12 patched to its front frame 32 and rear frame 34 would have plank adapter engaged with which front frame 32 and rear frame 34 to serve as supports for the Hawks of each platform 12 that extends from the front frame 32 and the rear frame 34, with each platform 12 that is added formed in the same way as the platform 12 described above is engaged with the first and second work stands 28, 30.

When the user is finished, the assembly 10 is broken down by the platform 12 being lifted off of the first and second work stands 28, 30. Each work stand is then put into its folded state by rotating the first frame and second frame together about their connection at their top 70. The spreaders are moved up so they are allowed to fold as the first frame and second frame fold together. See FIG. 12 which shows the work stand in a folded state.

In another embodiment, and with reference to FIGS. 14-23, the attachment portion 56 may have a first flange 64 engaged with the bar 58 in proximity to the first end 60 of the bar 58 and engages with the top 70 of the first work stand 28, and the attachment portion 56 may have a second flange 66 engaged with the bar 58 in proximity to the second end 62 of the bar 58 and the top 70 of the first work stand 28. The first flange 64 may have a first arm 100 that rests on the top 48 of the front frame 32, a second arm 102 that rests on the top 50 of the rear frame 34, a base 104 that extends through a gap 106 between the front frame 32 and the rear frame 34 and below the top of the front and rear frames. Essentially, the first and second arms and the base 104 form a T shape. The bar 58 may be engaged with the first flange 64 between the first arm 100 and the second arm 102 and above the base 104. The second flange 66 may have a first arm 100 that rests on the top 48 of the front frame 32, a second arm 102 that rests on the top 50 of the rear frame 34, a base 104 that extends through the gap 106 between the front frame 32 and the rear frame 34 and below the top of the front and rear frames. The bar 58 may be engaged with the second flange 66 between the first arm 100 and the second arm 102 of the second flange 66 and above the base 104 of the second flange 66.

The first plank adapter 52 may include a lock mechanism 108 that locks the first plank adapter 52 to the first work stand 28 so the first plank adapter 52 does not separate or come loose from the first work stand 28 when the lock mechanism 108 is in a locked state. The lock mechanism 108 may include a lock plate 110 that is rotatably engaged with the base 104 with a lock fastener 112 and a stop rivet 114 that is disposed in the base 104 and in a slot 116 in the lock plate 110 that allows the lock plate 110 to slide sideways from gravity into a position under the top 48 of the front frame 32 so the top 48 of the front frame 32 prevents the first plank adapter 52 from being lifted out of the gap 106 and the lock mechanism 108 is in the locked state, when the lock plate 110 is moved to a vertical position. The lock mechanism 108 is in the unlocked state and the stop rivet 114 moves to the slot's bottom 118 and the lock plate 110 aligns with the gap 106 so the lock plate 110 clears the top of the front and rear frames and the first plank adapter 52 can be lifted up through the gap 106.

Figure 20:
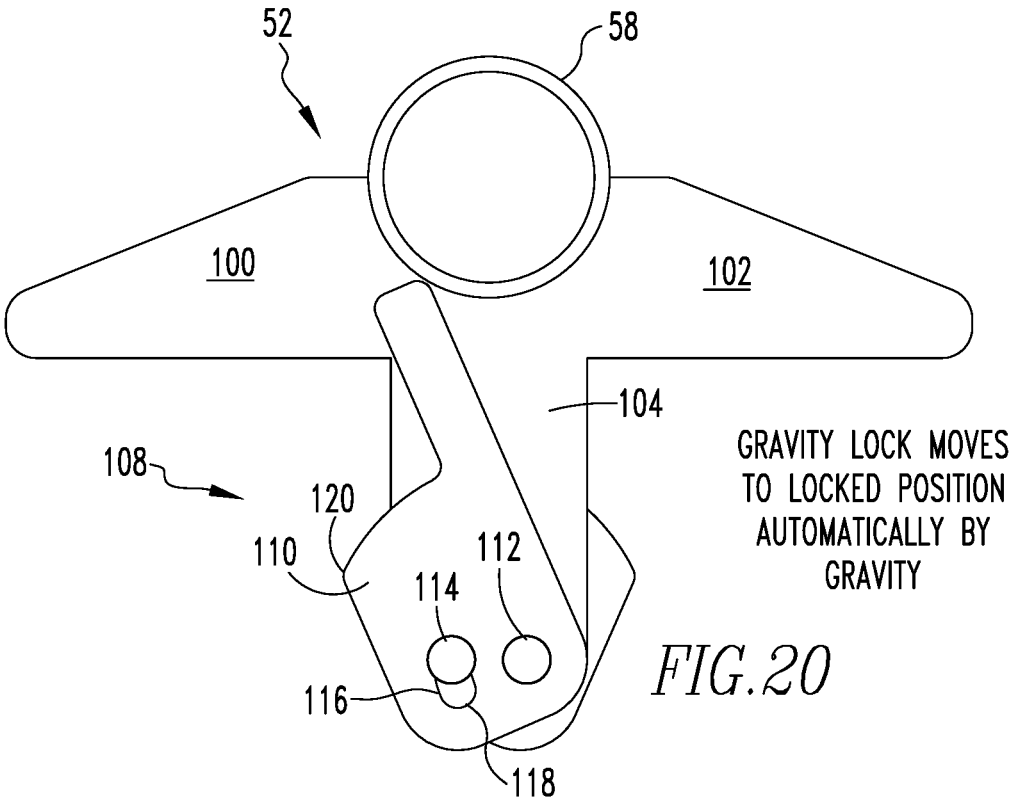
FIG. 20 is a side view of the plank adapter in the locked state.
Figure 21:
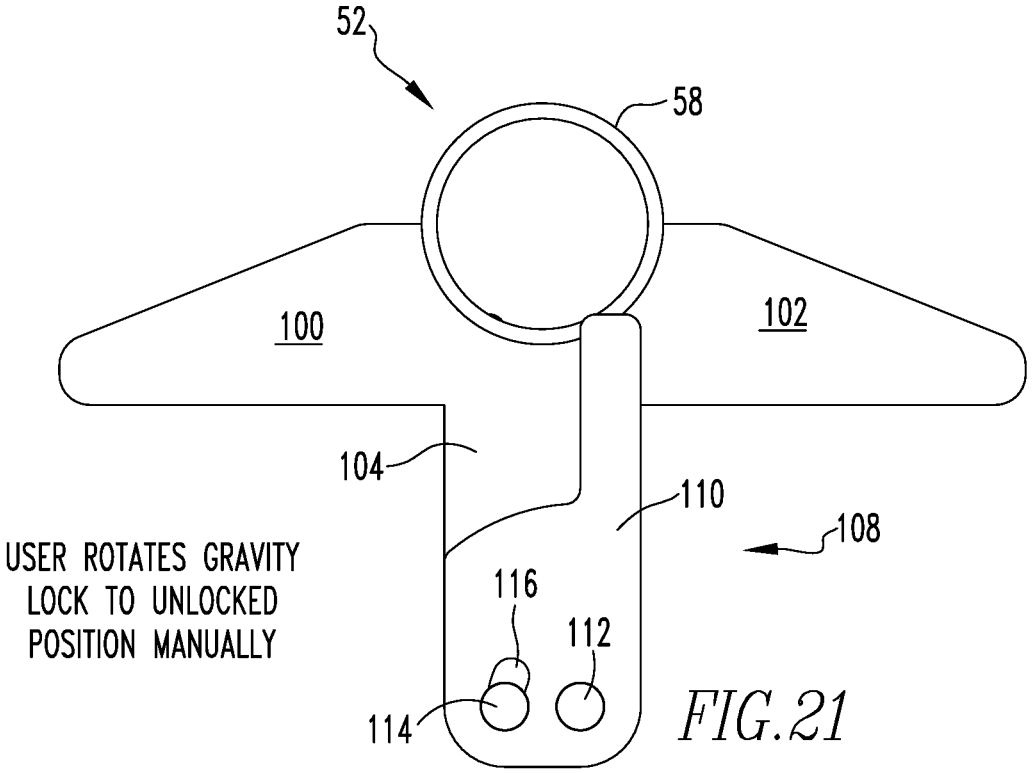
FIG. 21 is a side view of the plank adapter in the unlocked state.

The lock mechanism 108 is a gravity lock that moves to the locked state automatically by gravity. By placing the first plank adapter 52 into the gap 106 so the first arm 100 rests on the front frame top 48 and the second arm 102 rests on the rear frame top 50 and the base extends through the gap 106, the lock plate 110, simply under the force of gravity, will slide or move to the left, pivoting around the lock fastener 112. As the lock plate 110 rotates about the lock fastener 112, the slot 116 moves down relative to the stop rivet until the stop rivet 114 abuts the top of the slot 118, shown in FIG. 20. The corner 120 of the lock plate 110 is now positioned below the front frame top 48 so that if the first plank adapter 52 is attempted to be lifted out of the gap 106, the corner 120 of the lock plate 110 will catch on the bottom of the front frame top 48 and prevent the first plank adapter 52 from coming out of the gap 106. When it is desired to move the first plank adapter 52, the user rotates the lock plate 110 so it now aligns with the gap 106 so the corner 120 of the lock plate 110 is no longer under the front frame top 48, as shown in FIG. 21, and the first plank adapter 52 can be lifted straight up and out of the gap and separated from the first plank adapter 52.

Figure 14:
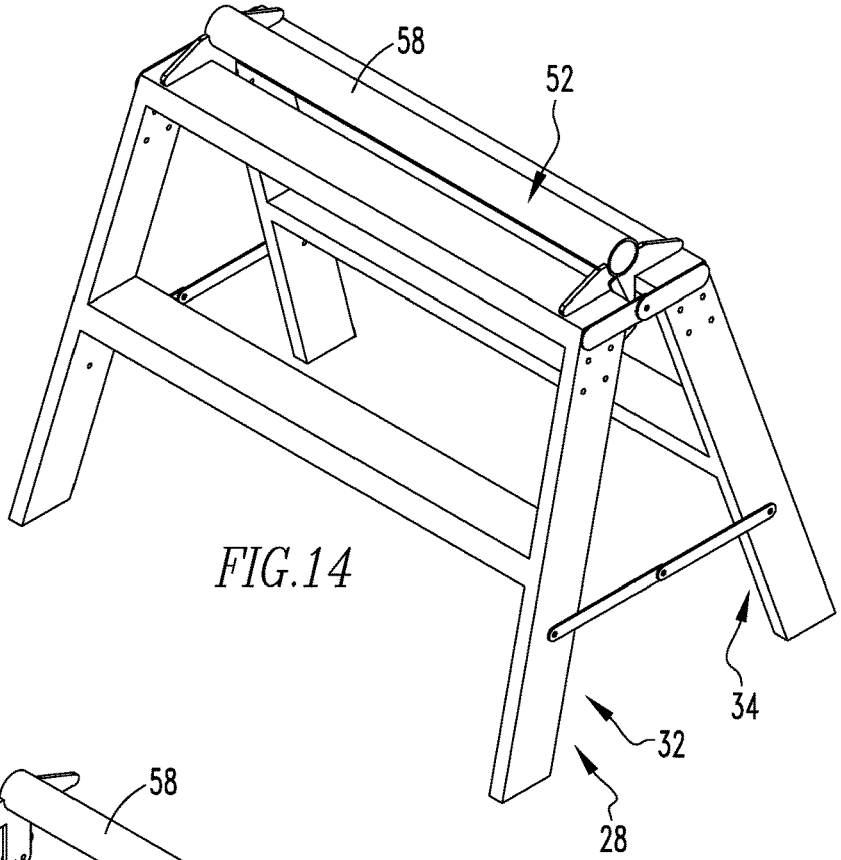
FIG. 14 is a perspective view of an alternate embodiment of the plank adapter installed in a work stand.
Figure 15:
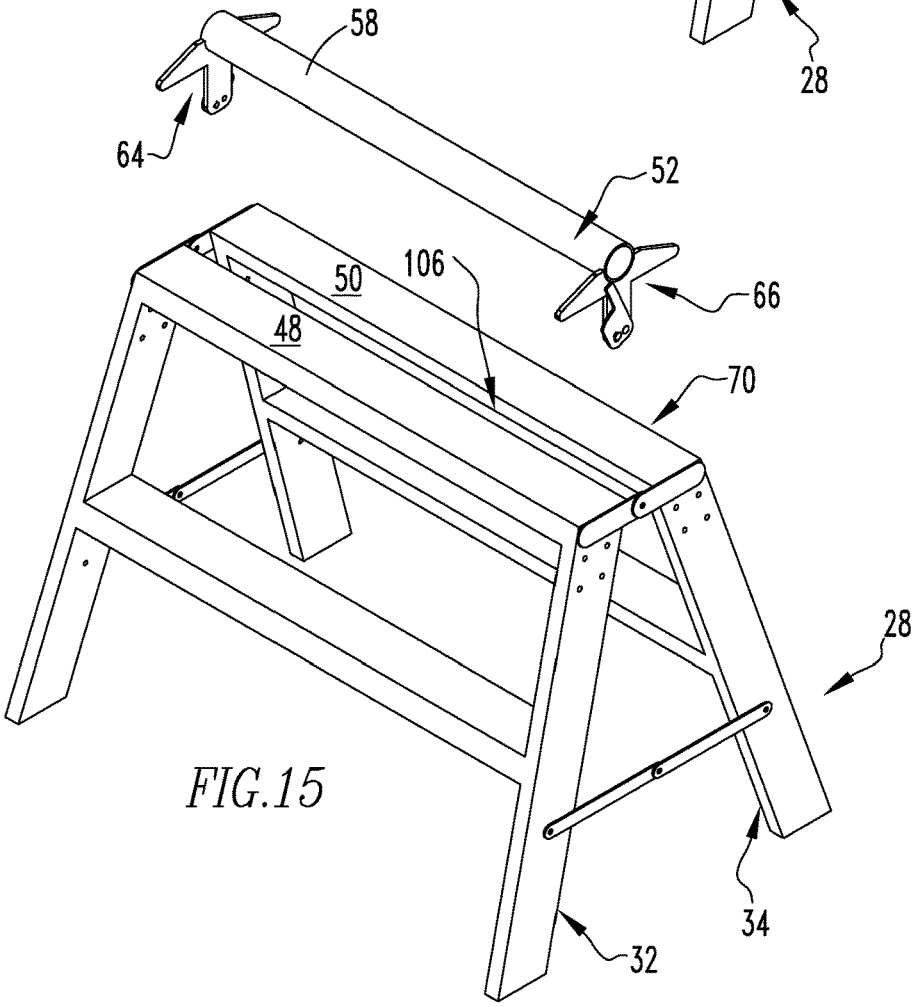
FIG. 15 is a perspective view of the plank adapter removed from the work stand.
Figure 16:
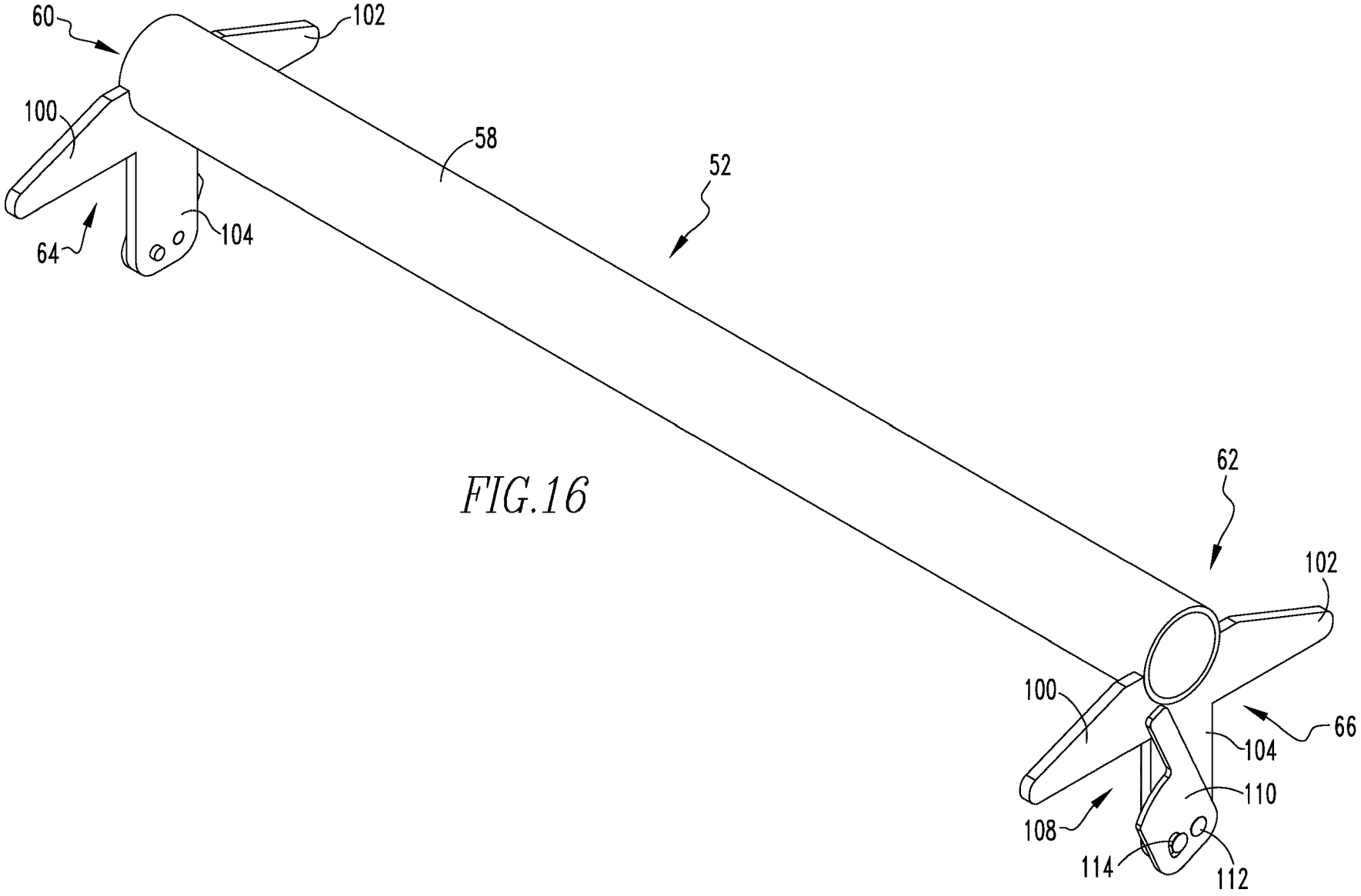
FIG. 16 is a perspective view of a plank adapter.
Figure 17:
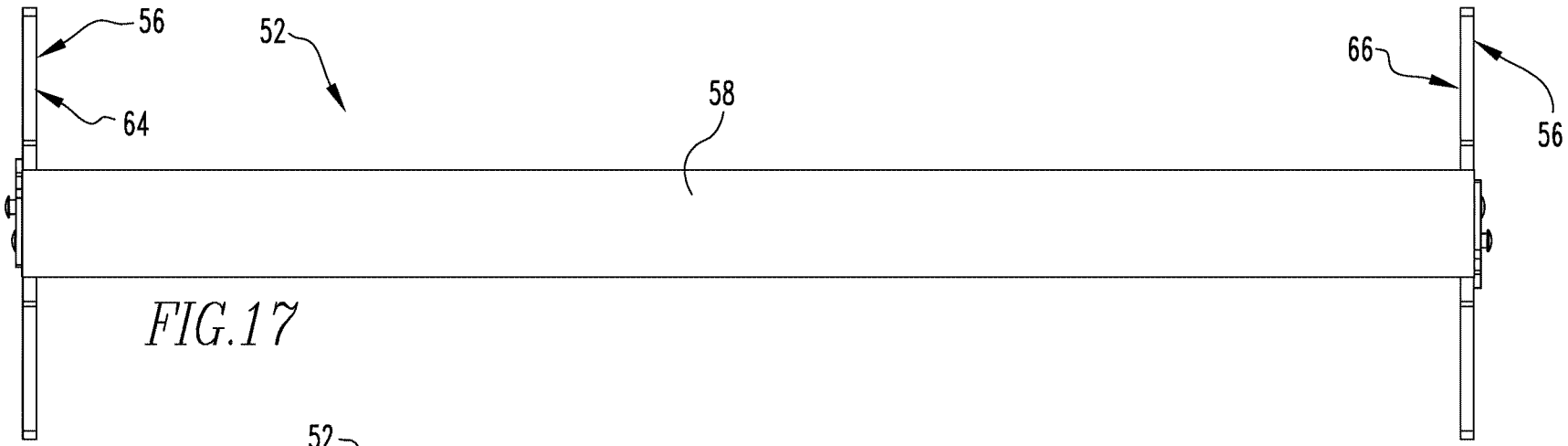
FIG. 17 is an overhead view of the plank adapter.
Figure 18:
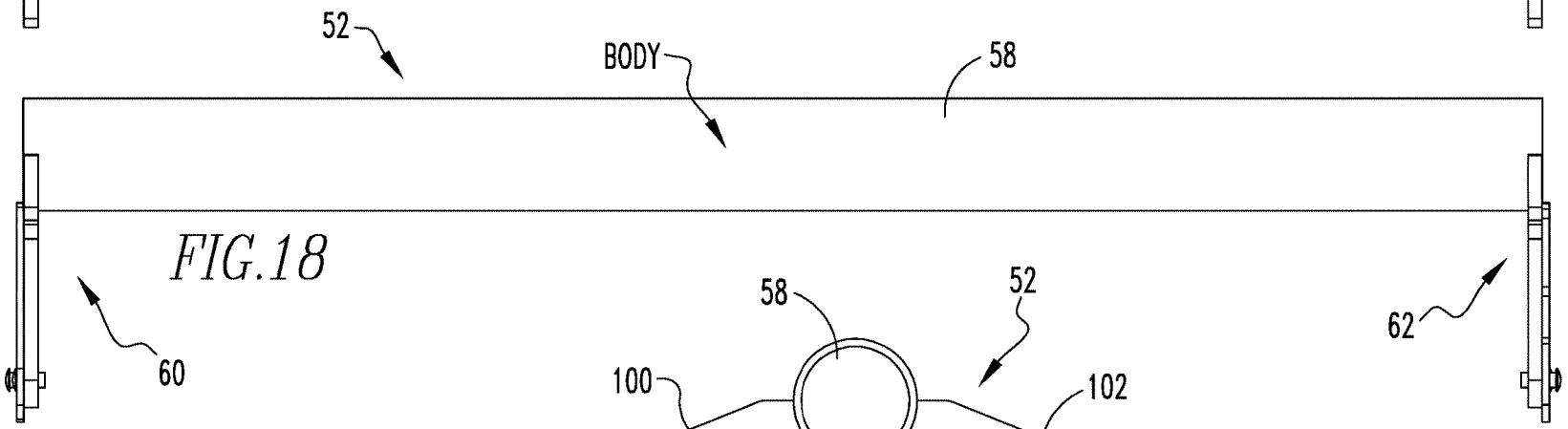
FIG. 18 is a front view of the plank adapter.
Figure 19:
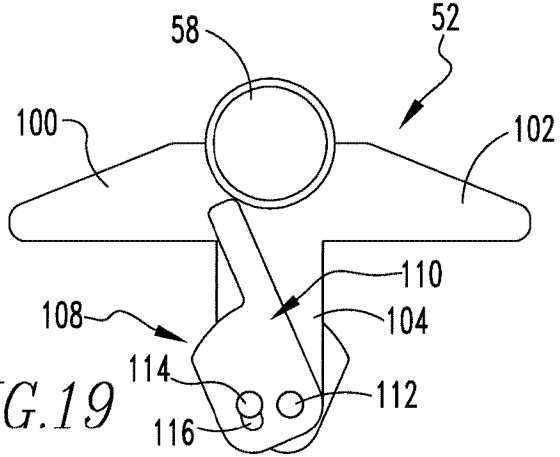
FIG. 19 is a side view of the plank adapter.
Figure 22:
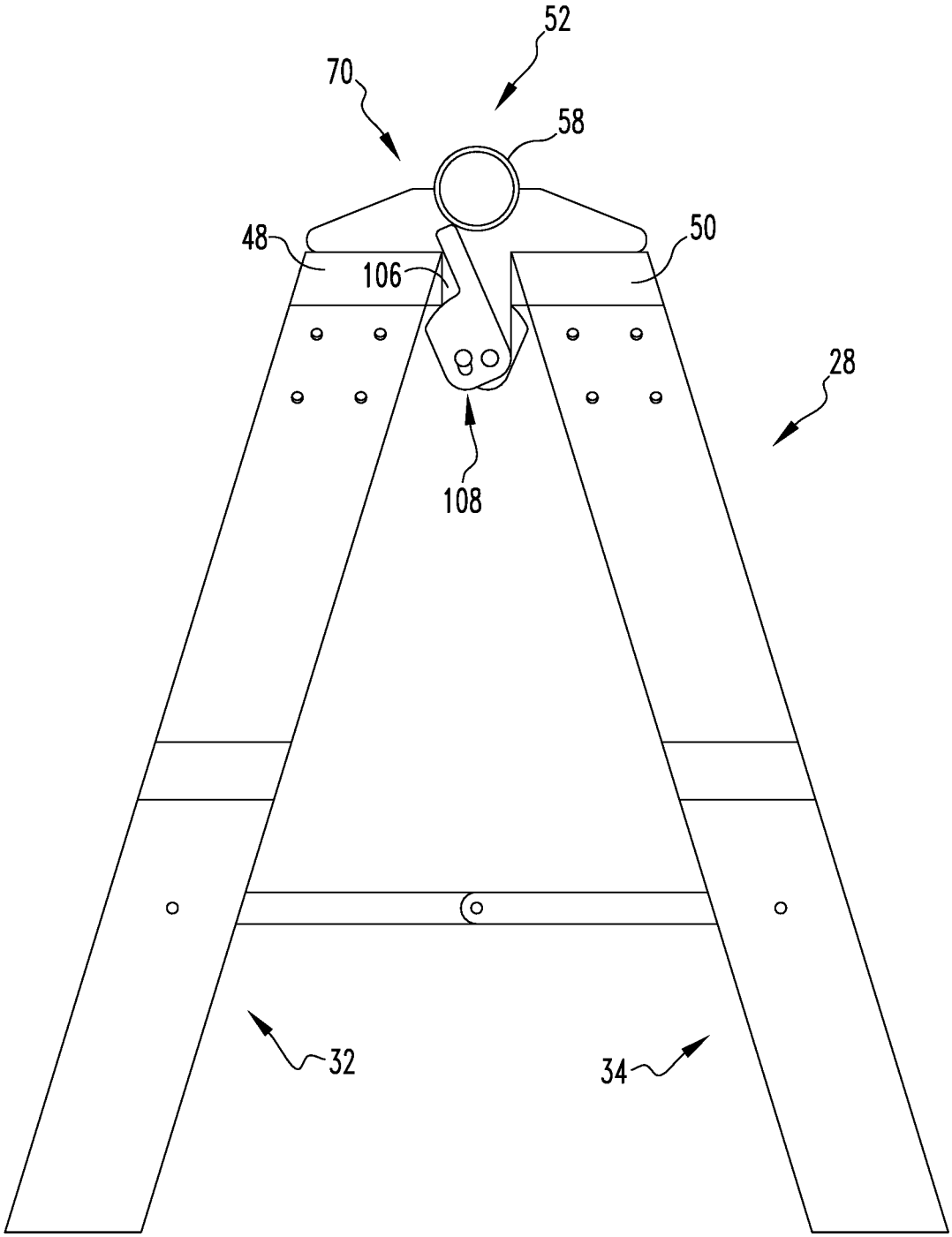
FIG. 22 is a side view of a work stand with the plank adapter.
Figure 23:
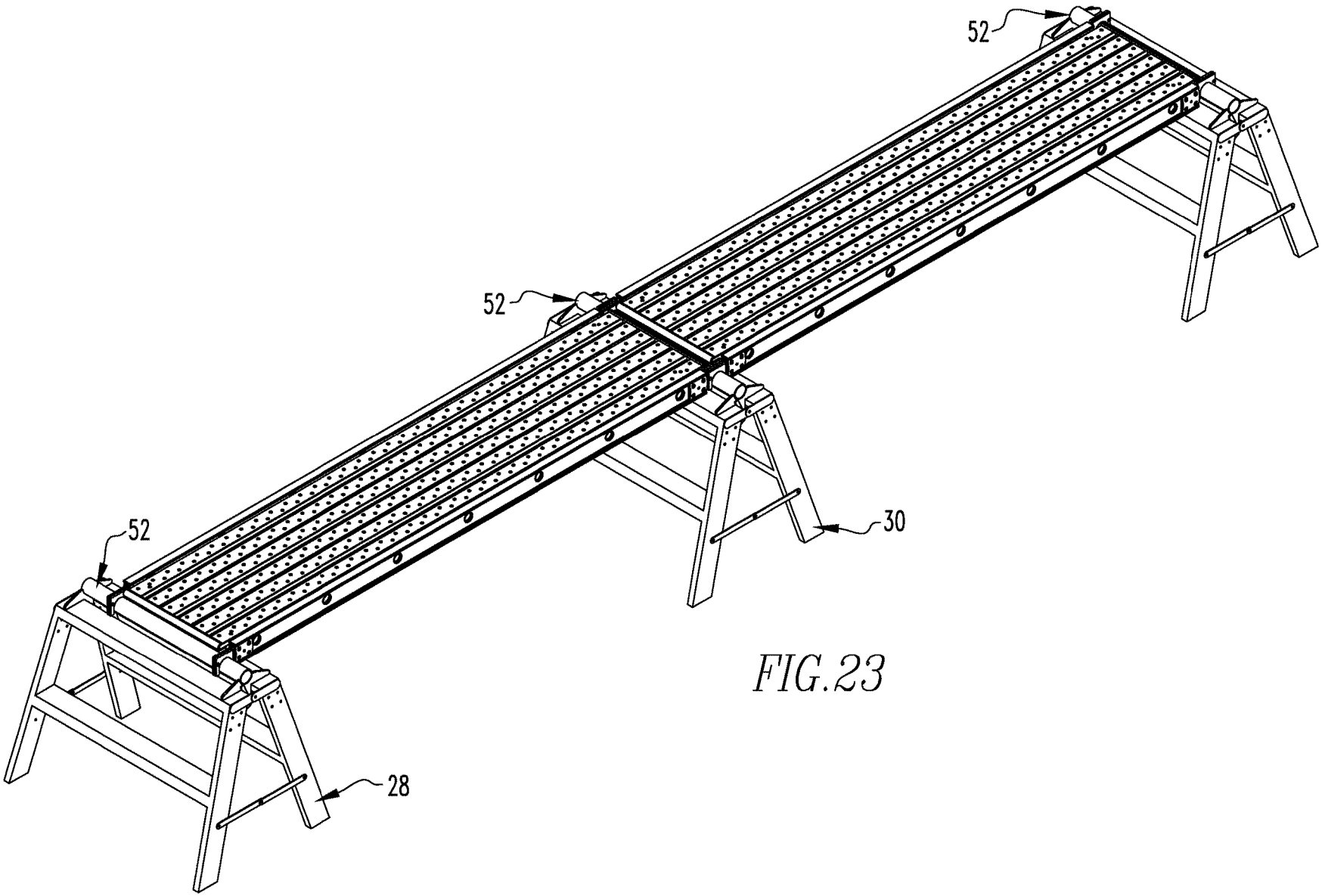
FIG. 23 is a perspective view of a scaffold formed of two platforms and three work stands of the present invention.

FIG. 14 is a perspective view of an alternate embodiment of the plank adapter installed in a work stand. FIG. 15 is a perspective view of the plank adapter removed from the work stand. FIG. 16 is a perspective view of a plank adapter. FIG. 17 is an overhead view of the plank adapter. FIG. 18 is a front view of the plank adapter. FIG. 19 is a side view of the plank adapter. FIG. 20 is a side view of the plank adapter in the locked state. FIG. 21 is a side view of the plank adapter in the unlocked state. FIG. 22 is a side view of a work stand with the plank adapter. FIG. 23 is a perspective view of a scaffold formed of two platforms and three work stands of the present invention.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An assembly upon which a user stands comprising:

a platform having a first hook and a second hook extending from a first end of the platform, and a third hook and a fourth hook extending from a second end of the platform, the second end of the platform in opposition with and spaced relation with the first end of the platform, the platform defining a plane on which the user stands;

a first work stand;

second work stand, each work stand having a front frame and a rear frame, each frame having a first rail and a second rail in parallel and spaced relationship with the first rail, a front cross bar engaged with the first and second rails of the front frame, a rear cross bar engaged with the first and second rails of the rear frame, a first spreader engaged with the first rail of the front frame and the first rail of the rear frame, a second spreader engaged with the second rail of the front frame and the second rail of the rear frame, the front frame and the rear frame of each work stand forming an upside down V;

a first plank adapter engaged with the first work stand: the first plank adapter has an attachment portion and a bar, the attachment portion engaged with the bar and the first work stand to hold the bar in spaced relationship with the first work stand, the first and second hooks on the first end of the platform engage with and rest on the bar to hold the platform in place on the bar, the bar has a first end and a second end, the attachment portion has a first flange directly attached to the bar in proximity to the first end of the bar and directly attached to the first rail of the front frame of the first work stand, and the attachment portion has a second flange directly attached to the bar in proximity to the second end of the bar and directly attached to the second rail of the front frame of the first stand, with the first and second rails of the front frame disposed between the first flange and the second flange; and a second plank adapter engaged with the second work stand, the second plank adapter having a bar on which the third and fourth hooks on the second side of the platform engage with and rest to hold the platform in place on the bar of the second work stand, a top surface of the platform and first and second work stands and first and second plank adapters define a flat plane.

2. The assembly of claim 1 including fasteners that attach each flange to each flange's corresponding rail.

3. The assembly of claim 2 wherein the first flange is attached with the fasteners in proximity to the top of the first rail of the first work stand and the second flange is attached with the fasteners in proximity to the top of the second rail of the first work stand.

4. The assembly of claim 3 wherein the bar has at least a portion of the bar's outer perimeter being curved to conform to the first hook and the second hook of the platform that rests upon the bar.

5. The assembly of claim 4 wherein the first flange and the second flange each have an opening in Which the bar of the first plank adapter is fixed.

6. The assembly of claim 5 wherein the first flange and the second flange each have a cut oat in which a top of the first frame of the first work stand fits.

7. The assembly of claim 6 wherein the first flange and the second flange each have a first flat section through which the fasteners extend into the first rail and the second rail, respectively, and a second section that has an opening in which the bar of the first plank adapter is fixed, the first section having three sides, the second section having essentially a half oval perimeter.

* * * * *